US012031461B2

(12) United States Patent
Weidauer

(10) Patent No.: US 12,031,461 B2
(45) Date of Patent: Jul. 9, 2024

(54) SHIFT GATE, SLIDING CAM SYSTEM AND CAMSHAFT

(71) Applicants: THYSSENKRUPP DYNAMIC COMPONENTS TECCENTER AG, Eschen (LI); thyssenkrupp AG, Essen (DE)

(72) Inventor: Marcel Weidauer, Raschau-Markersbach (DE)

(73) Assignees: THYSSENKRUPP DYNAMIC COMPONENTS TECCENTER AG, Eschen (LI); thyseenkrupp AG, Essen (DE)

( * ) Notice: Subject to any disclaimer, the term of this patent is extended or adjusted under 35 U.S.C. 154(b) by 13 days.

(21) Appl. No.: 17/761,825

(22) PCT Filed: Sep. 15, 2020

(86) PCT No.: PCT/EP2020/075787
§ 371 (c)(1),
(2) Date: Mar. 18, 2022

(87) PCT Pub. No.: WO2021/052973
PCT Pub. Date: Mar. 25, 2021

(65) Prior Publication Data

US 2022/0341351 A1 Oct. 27, 2022

(30) Foreign Application Priority Data

Sep. 18, 2019 (DE) ..... 10 2019 125 100.1

(51) Int. Cl.
*F01L 13/00* (2006.01)
*F01L 1/047* (2006.01)

(52) U.S. Cl.
CPC ..... *F01L 13/0036* (2013.01); *F01L 1/047* (2013.01); *F01L 2013/0052* (2013.01); *F01L 2013/10* (2013.01)

(58) Field of Classification Search
CPC ..... F01L 13/0036; F01L 2013/0052; F01L 2013/10; F01L 1/047; F01L 2011/0473; F01L 2820/02
See application file for complete search history.

(56) References Cited

U.S. PATENT DOCUMENTS

2010/0224154 A1 9/2010 Elendt et al.
2010/0242884 A1 9/2010 Meintschel et al.
(Continued)

FOREIGN PATENT DOCUMENTS

CN 102345476 A 2/2012
CN 104564201 A 4/2015
(Continued)

OTHER PUBLICATIONS

English Translation of International Search Report Issued in PCT/EP2020/075787 dated Feb. 11, 2021.
(Continued)

*Primary Examiner* — Loren C Edwards
(74) *Attorney, Agent, or Firm* — thyssenkrupp North America, LLC

(57) ABSTRACT

A shift gate for a sliding cam system may include at least two shift grooves for engagement of at least one actuator pin. The two shift grooves run against a direction of rotation and transform from a first inlet portion for the actuator pin into a second outlet portion for the actuator pin. The two shift grooves cross one another in an intersection region between the two portions. In the intersection region, the two shift
(Continued)

grooves each have a maximum axial shift stroke that is greater than half a total axial shift stroke, in particular a slide travel, of the shift gate.

10 Claims, 1 Drawing Sheet

(56) References Cited

U.S. PATENT DOCUMENTS

| | | | | |
|---|---|---|---|---|
| 2012/0024245 | A1 | 12/2012 | Nendel | |
| 2014/0020642 | A1 | 1/2014 | Stolk et al. | |
| 2015/0059677 | A1 | 3/2015 | Doller | |
| 2016/0281553 | A1* | 9/2016 | Elendt | F01L 13/0036 |
| 2017/0122141 | A1 | 5/2017 | Nishimura et al. | |
| 2017/0167325 | A1 | 6/2017 | Di Nunno | |
| 2019/0032521 | A1 | 1/2019 | Hirschmann et al. | |
| 2019/0032525 | A1 | 1/2019 | Altherr et al. | |

FOREIGN PATENT DOCUMENTS

| | | | | |
|---|---|---|---|---|
| CN | 107013277 | A | 8/2017 | |
| CN | 114165309 | A | 3/2022 | |
| DE | 10 148 177 | A1 | 4/2003 | |
| DE | 10148178 | A1 | 4/2003 | |
| DE | 10 2007 054 978 | A1 | 5/2009 | |
| DE | 10 2011 114 300 | A1 | 3/2013 | |
| DE | 10 2012 012 064 | A1 | 12/2013 | |
| DE | 102012211858 | A1 | 1/2014 | |
| DE | 10 2012 218 803 | A1 | 4/2014 | |
| DE | 10 2012 022 555 | A1 | 5/2014 | |
| DE | 102012112038 | A1 | 6/2014 | |
| DE | 10 2013 111 476 | A1 | 4/2015 | |
| DE | 10 2013 220 554 | A1 | 4/2015 | |
| DE | 102013221244 | A1 * | 4/2015 | F01L 13/0036 |
| DE | 10 2013 223 299 | A1 | 5/2015 | |
| DE | 10 2014 204 570 | A1 | 7/2015 | |
| DE | 10 2014 209 431 | A1 | 11/2015 | |
| DE | 10 2014 215 428 | B3 | 2/2016 | |
| DE | 10 2014 017 036 | B3 | 3/2016 | |
| DE | 10 2014 222 671 | A1 | 3/2016 | |
| DE | 102014017036 | B3 * | 3/2016 | F01L 13/0036 |
| DE | 102016012813 | A1 | 4/2017 | |
| DE | 10 2015 015 832 | A1 | 6/2017 | |
| DE | 10 2016 015 278 | A1 | 7/2017 | |
| DE | 10 2016 207 616 | A1 | 11/2017 | |
| DE | 10 2016 124 851 | A1 | 6/2018 | |
| EP | 2 839 122 | A1 | 2/2015 | |
| JP | S 5244314 | A | 4/1977 | |

OTHER PUBLICATIONS

Li, Zhaoming, "Analysis and calculation of transmission manipulation mechanism of NJ50 motorcycle engine", Guangxi Nanning Machinery factory Engineering Science and Technology II Series, Small Internal Combustion Engines and Motorcycles, vol. 3 (Dec. 31, 1985). English abstract attached.

Tang, Rongzhong, "Shift stroke design analysis for manual transmissions", Auto Gear Technology (Qichi Keji), Issue 1 (May 15, 2009). English abstract attached.

* cited by examiner

SHIFT GATE, SLIDING CAM SYSTEM AND CAMSHAFT

CROSS REFERENCE TO RELATED APPLICATIONS

This application is a U.S. National Stage Entry of International Patent Application Serial Number PCT/EP2020/075787, filed Sep. 15, 2020, which claims priority to German Patent Application No. DE 10 2019 125 100.1, filed Sep. 18, 2019, the entire contents of both of which are incorporated herein by reference.

FIELD

The present disclosure generally relates to shift gates, sliding cam systems, and camshafts.

BACKGROUND

In general, shift gates are used for moving or adjusting sliding cam elements in variable valve timing systems. Sliding cam elements with shift gates therefore constitute an important component of variable valve timing systems in internal combustion engines. Basically, such valve timing systems can influence the valve lift movements of the inlet and exhaust valves by changing the cam profiles, or can disable valves by changing the cam profiles.

For axially sliding or adjusting the sliding cam element, shift gates conventionally comprise shift grooves. Known configurations of shift grooves are for example S grooves, double S grooves, Y grooves and X grooves.

DE 10 2012 012 064 A1, cited initially, and DE 10 2013 111 476 A1 disclose sliding cams with shift gates which have an X groove for axial movement of the sliding cam. An actuator pin engages in the respective groove portion of the X groove and slides the sliding cam in an axial direction. In general, X grooves have the disadvantage that at low shift speed, because of the low rotation speed of the sliding cam or camshaft, there is a risk of shift failure. The shift dynamics in the sliding direction are insufficient to move the sliding cam securely by means of a latching device, for example from a first axial position into a second axial position. The sliding cam can therefore jump back into the first axial position.

A shift gate with gate tracks arranged in a Y shape is described for example in DE 10 2014 017 036 B3. The gate tracks are formed by grooves which transform into one another at an opening point. Shift gates with Y grooves, in comparison with shift gates with X grooves, require a greater axial installation space since in Y grooves, the maximum slide travel of the sliding cam corresponds to the maximum shift stroke of the respective gate track.

Thus a need exists for a shift gate in which installation space is reduced because of an improved structural design and operating reliability is increased. Further, a need also exists for sliding cam system and cam shaft.

DETAILED DESCRIPTION

Figure 1:
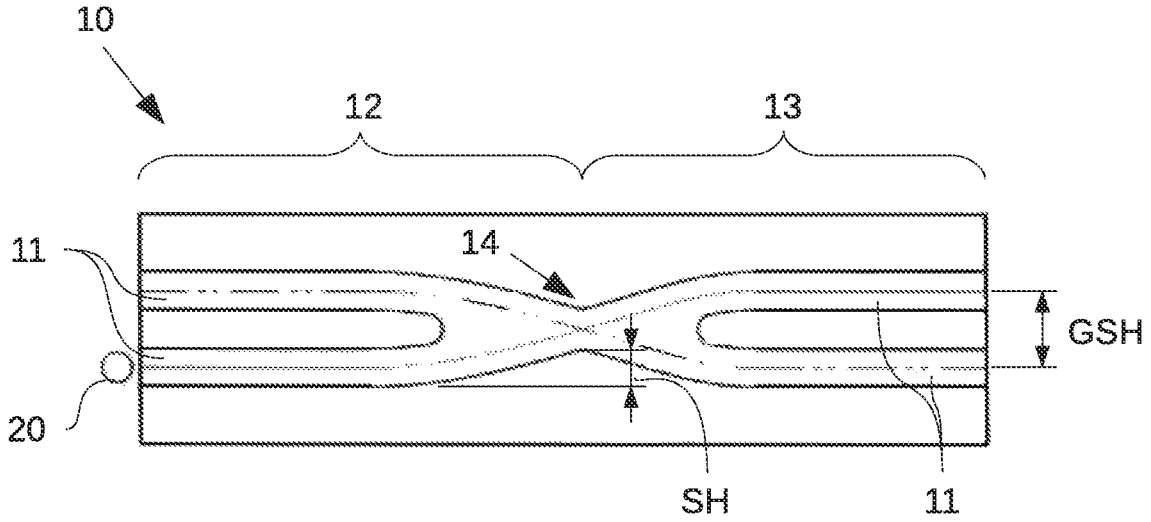
Fig. 1 PRIOR ART
FIG. 1 is a schematic view of a shift gate with an X shift groove according to the prior art.

Although certain example methods and apparatuses have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art. In some examples, a shift gate for a sliding cam system, may have having at least two shift grooves for engagement of at least one actuator pin. The two shift grooves run against a direction of rotation and transform from a first portion, in particular an inlet portion for the actuator pin, into a second portion, in particular an outlet portion for the actuator pin. The two shift grooves cross one another in an intersection region between the two portions. In the intersection region, the two shift grooves each have a maximum axial shift stroke which is greater than half a total axial shift stroke of the shift gate.

The invention has various advantages. Because of the intersecting shift grooves, the shift gate according to the invention, in comparison with known shift gates with Y groove design, requires less axial installation space. The shift grooves cross one another in the intersection region between the first portion and the second portion, and change their axial position relative to the axially opposite shift groove. The total axial shift stroke of the shift gate is thus implemented in a narrower axial circumferential region than in the shift gate with Y groove design.

The total axial shift stroke of the shift gate corresponds to the maximum slide travel of the shift gate in the longitudinal direction which the shift gate covers on a sliding process between at least two axial positions, in particular axial end positions, e.g. on a shaft, in particular a camshaft. In other words, on a sliding process, the shift gate is moved from a first axial position to a second axial position, wherein the axial slide travel covered corresponds to the total axial shift stroke of the shift gate.

On a sliding process, the shift gate is moved axially in the sliding direction over more than half the total axial shift stroke, starting from the first axial position, by an actuator pin engaging in one of the two shift grooves. Here, in the first portion, the respective shift groove slides with a side wall facing the sliding direction along the actuator pin. If the actuator pin is in the region of the maximum axial shift stroke of the shift groove, the shift gate is moved by more than half the total axial shift stroke. In this position, the shift gate is closer to the second axial position than the first axial position, so that the shift gate is pulled, e.g. by a latch device, to the second axial position. In the intersection region, the actuator pin changes to a side wall of the shift groove facing away from the sliding direction, and slides along this in the second portion until the shift gate reaches the second axial position.

The first axial position corresponds to the axial starting position from which the shift gate is moved, during a sliding process, in the direction of the further, in particular second, axial position. The maximum axial shift stroke of the respective shift groove corresponds to a travel covered by the shift gate in the sliding direction from the first axial position to the second axial position.

Since the maximum axial shift stroke is more than half the total axial shift stroke of the shift gate, the shift gate—and thus preferably a sliding cam element coupled to the shift gate—is securely moved in the sliding direction from the first axial position to the second axial position. This advantageously prevents an unacceptable return movement or jump-back of the sliding cam element, in particular at low shift speeds, and hence operating reliability is increased.

Preferred embodiments of the invention are indicated in the subclaims.

In a particularly preferred embodiment, the maximum axial shift stroke of the shift grooves is smaller than the total axial shift stroke of the shift gate. The maximum axial shift stroke is therefore preferably greater than half the total axial shift stroke, and smaller than the entire total axial shift stroke of the shift gate. In other words, the maximum axial shift stroke of the respective shift groove lies in a range between half and the entire total axial shift stroke of the shift gate. An axial extent of the shift gate may thereby be reduced, leading to a saving in axial installation space.

In a preferred embodiment, the two shift grooves each have an inlet flank in the first portion and an outlet flank in the second portion, said flanks running parallel to one another. In this embodiment, the two shift grooves have an axial distance from one another which corresponds to at least half the total axial shift stroke of the shift gate.

The axial distance is here formed between the respective inlet flank of one of the two shift grooves and the respective outlet flank of the other of the two shift grooves. At low shift speeds in particular, this prevents an unacceptable autonomous return movement of the shift gate or sliding cam element, and hence increases operating reliability.

In a further preferred embodiment, in the second portion starting from the intersection region, the two shift grooves each comprise a braking flank for braking an actuator pin, which forms a continuous transition to the outlet flank. The braking flank here forms a smooth transition. This has the advantage that on a sliding process, the actuator pin transforms smoothly or gently into the outlet flank via the braking flank, so that high axial forces are prevented. This improves the shift behavior of the shift gate and extends a service life of the actuator pin.

Preferably, the braking flank is configured so as to be arcuate at least in portions. The braking flank may be formed so as to be concave at least in portions. Thus axial forces acting on the actuator pin are further reduced. In addition, the braking flank may have a rectilinear portion. It is also conceivable that the braking flank is formed from several rectilinear flank portions.

In a further preferred embodiment, the two shift grooves are separate from one another in the first portion and partially axially overlap one another in the second portion so that the two shift grooves form a common groove. In other words, in the first portion, the shift grooves are each formed by a separate groove and transform into one another in the intersection region such that they form a common groove in the second portion. Preferably, the two shift grooves in the first portion have a first axial spacing from one another and in the second portion a second axial spacing which is smaller than the first axial spacing. Here it is advantageous that, because of the axial overlap, the axial installation space for forming the shift grooves is reduced and the above-mentioned braking flanks become possible.

Preferably, the common groove has a groove width which is greater than the groove width of the respective shift groove in the first portion. The groove width of the common groove may correspond to at least twice the groove width of the respective shift groove in the first portion. The groove width of the common groove may also be smaller than or greater than twice the width of the respective shift groove in the first portion. Because of the great width of the common groove, it is possible to implement the braking flanks, whereby axial forces acting on the actuator pin during a sliding process can be reduced. This contributes further to increasing the operating reliability.

Further preferably, at least one guide web is formed between the two shift grooves, which in the first portion extends at least partially along the shift grooves. According to this embodiment, the guide web tapers towards the intersection region. The two shift grooves may have a constant groove width or a varying, in particular changing groove width along the guide web.

According to the auxiliary claim 9, the invention concerns a sliding cam system with at least one sliding cam element, at least one multipin actuator, in particular a double pin actuator. The sliding cam element has at least one shift gate and can be locked in at least two axial positions. The shift gate has at least two shift grooves, wherein during a sliding process, a respective one of the two shift grooves cooperates with at least one actuator pin of the multiple actuator. The two shift grooves run against a rotation direction and transform from a first portion into a second portion, wherein the two shift grooves cross one another between the two portions. The two shift grooves each have a maximum axial shift stroke which is greater than half a total axial shift stroke of the shift gate.

In a preferred embodiment of the sliding cam system according to the invention, the total axial shift stroke of the shift gate is substantially equal to the distance between the two axial positions of the sliding cam element.

In a further preferred embodiment of the sliding cam system according to the invention, a latching device is provided and configured such that, during a sliding process, after reaching the maximum axial shift stroke of the respective shift groove, it moves, in particular pulls, the sliding cam element in the sliding direction to the corresponding axial position.

Preferably, the multipin actuator of the sliding cam system according to the invention comprises at least two actuator pins which have a distance from one another corresponding at least to half the total axial shift stroke of the shift gate.

According to the auxiliary claim 13, the invention concerns a camshaft with at least one shift gate according to the invention and/or at least one sliding cam system according to the invention.

For the advantages of the sliding cam system and the camshaft, reference is made to the advantages explained in connection with the shift gate. In addition, the sliding cam system, the camshaft and the method may alternatively or additionally comprise individual or a combination of multiple features mentioned with respect to the shift gate.

The invention is explained in more detail below with further features with reference to the appended drawings. The embodiment illustrated constitutes examples of how the shift gate according to the invention may be configured.

FIG. 1 shows schematically an implementation of a circumferential portion of a shift gate 10 according to the prior art, wherein the shift gate 10 has two shift grooves 11 which are together formed as an X groove. The shift gate 10 comprises a first portion 12, a second portion 13 and an intersection region 14 arranged in between in the circumferential direction. The two shift grooves 11 run from the first portion 12 through the intersection region 14 into the second portion 13 and cross one another in the intersection region 14.

As FIG. 1 shows, the two shift grooves 11 have a same axial distance from one another in the two portions 12, 13. The two shift grooves 11 thus have a maximum axial shift stroke SH in the intersection region 14 which corresponds to half the total shift stroke GSH of the shift gate 10. FIG. 1 furthermore shows an actuator pin 20 which engages in one of the two shift grooves 11 and cooperates therewith for axial sliding of the shift gate 10.

The maximum axial shift stroke SH described above according to FIG. 1 has the disadvantage that if the shift speeds are too low, e.g. due to low rotation speeds of a camshaft (not shown) to which the shift gate 10 is coupled, after the actuator pin 20 has passed the intersection region 14, there is a risk of autonomous return movement or jump-back of the shift gate 10 into the first axial position, in particular the starting position.

Figure 2:
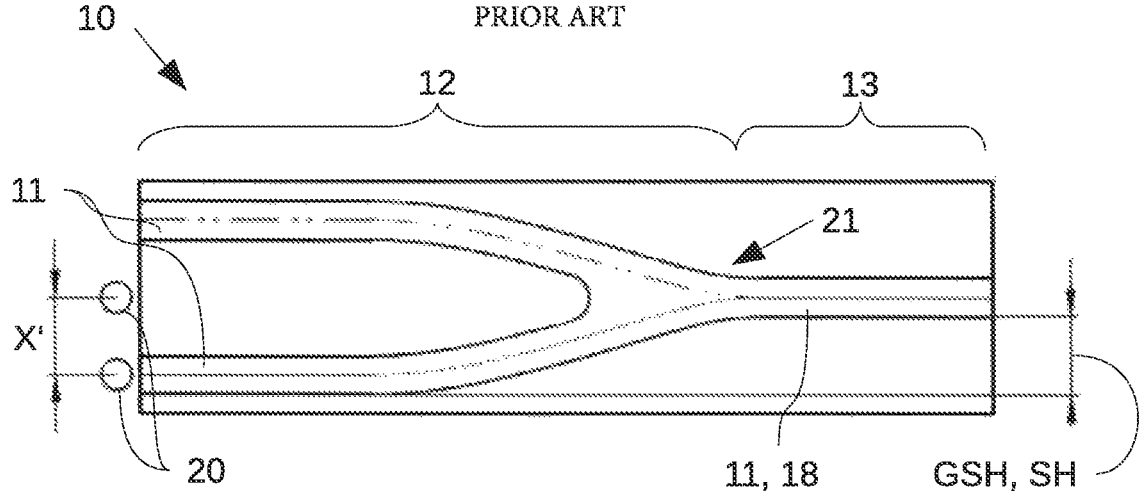
Fig. 2 PRIOR ART
FIG. 2 is a schematic view of a shift gate with a Y shift groove according to the prior art.

FIG. 2 shows a schematic implementation of a circumferential portion of a further shift gate 10 according to the prior art, wherein the shift gate 10 has two shift grooves 11 which jointly form a Y groove. In contrast to the shift gate 10 from FIG. 1, the two shift grooves 11 run from the first portion 12 into the second portion 13 without crossing. The shift grooves 11 in the second portion 13 form a common groove 18 which substantially has a groove width which corresponds to the two identical groove widths of the two shift grooves 11 in the first portion 12. Furthermore, the two shift grooves 11 have an axial distance from one another only in the first portion 12. In the second portion 13, the two shift grooves 11 are formed completely congruent with one another.

As FIG. 2 shows, the two shift grooves 11 have a maximum axial shift stroke SH in the opening region 21 which corresponds to the total shift stroke GSH of the shift gate 10. In other words, the maximum axial shift stroke SH of the respective shift grooves 11 corresponds to the full axial stroke or full slide travel of the shift gate 10. In comparison with the shift gate 10 with X groove arrangement according to FIG. 1, the shift gate 10 with Y groove arrangement has a greater axial extent of the circumferential region in which the two shift grooves 11 extend in the circumferential direction. The shift gate 10 according to FIG. 2 thus requires more installation space.

According to FIG. 2, furthermore at least two actuator pins 20 are required for axial sliding of the shift gate 10. The axial distance X' between the two pins 20 corresponds to the total axial shift stroke GSH of the shift gate 10. The shift gate 10 shown in FIG. 2 has the further disadvantage that it has a hard transition in the opening region 21 in which the two shift grooves 11 open into one another, so that during a sliding process, in the opening region 21, high axial forces act on the engaged actuator pin 20.

Figure 3:
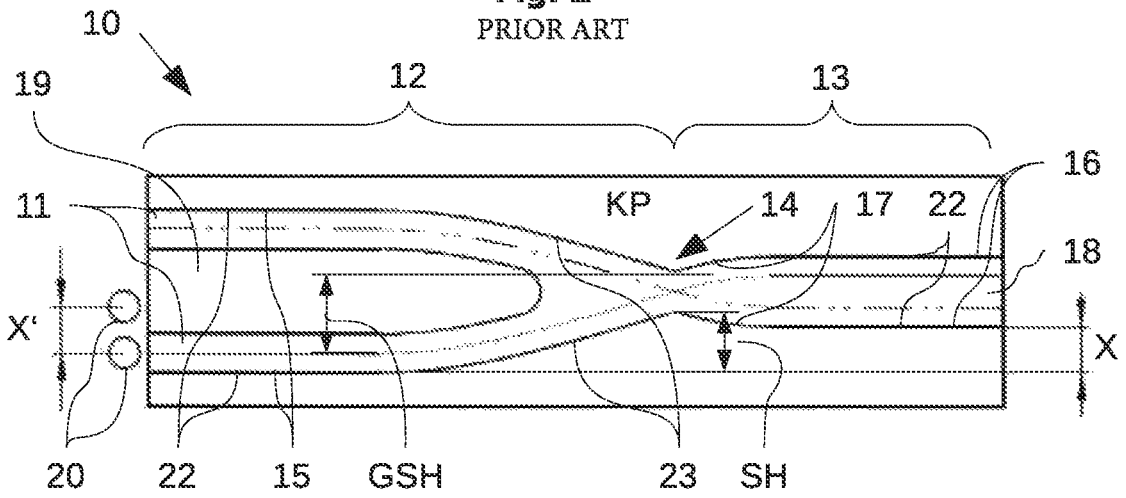
FIG. 3 is a schematic view of an example shift gate of the present disclosure.

FIG. 3 shows an implementation of a circumferential region of the shift gate 10 according to a preferred exemplary embodiment of the invention. The circumferential region shown, like the circumferential regions shown in FIGS. 1 and 2, corresponds to a schematic illustration. The shift gate 10 serves for axial sliding of a sliding cam element (not shown) on a camshaft. The shift gate 10 may also be used to slide other elements arranged on a shaft in the longitudinal direction.

The shift gate 10 comprises a first portion 12, a second portion 13 and an intersection region 14 arranged in between in the circumferential direction. The first portion 12 corresponds to an inlet portion in which an actuator pin 20 enters the associated shift groove 11 in order to cooperate therewith for an axial sliding of the shift gate 10 or of a sliding cam element (not shown) coupled to the shift gate 10. The second actuator portion 13 corresponds to an outlet portion in which the actuator pin 20 is situated after the sliding process and from which the actuator pin 20 preferably exits the groove.

The shift gate 10 furthermore has two shift grooves 11 which run against the rotation direction of the shift gate 10 from the first portion 12 into the second portion 13, and cross one another in the intersection region 14. The two shift grooves 11 cross at a crossing point KP in the intersection region 14. In other words, the shift grooves 11 change axial sides relative to the first portion 12. It should be mentioned that the intersection region 14 does not form a clearly separated intermediate region, but is formed by respectively a part of the first portion 12 and a part of the second portion 13. The crossing point KP forms the center of the intersection region 14.

As FIG. 3 shows, in the first portion 12 the two shift grooves 11 have a first axial distance from one another, and in the second portion 13 a second axial distance which is less than the first axial distance. The axial distances are measured between the mutually parallel shift groove regions 22 of the two shift grooves 11 in the respective portion 12, 13.

In the intersection region 14, the two shift grooves 11 each have a maximum axial shift stroke SH which is greater than half a total axial shift stroke GSH of the shift gate 10. In addition, the maximum axial shift stroke SH of the shift grooves 11 is smaller than the total axial shift stroke GSH. To summarize, the maximum axial shift stroke SH is thus greater than half the total shift stroke GSH and smaller than the entire total shift stroke GSH of the shift gate 10.

The total axial shift stroke GSH of the shift gate 10 corresponds to the maximum slide travel of the shift gate 10 in the longitudinal direction of e.g. a shaft (not shown), in particular a camshaft, which the shift gate 10 covers during a sliding process between at least two axial positions, in particular axial end positions, e.g. on a shaft, in particular a camshaft. In other words, during a sliding process, the shift gate 10 is moved from a first axial position to a second axial position, wherein the axial slide travel covered corresponds to the total axial shift stroke GSH of the shift gate 10.

As evident from FIG. 3, the two shift grooves 11 are formed separately from one another in the first portion 12. In concrete terms, in the first portion 12, a guide web 19 is axially arranged between the shift grooves 11 and partially separates the two shift grooves 11 from one another in the circumferential direction. The guide web 19 extends partially along the shift grooves 11 and tapers towards the intersection region 14. The shift grooves 11 may have a constant groove width or a varying, in particular changing groove width along the guide web 19. The groove widths of the two shift grooves 11 are the same size in the first portion 12.

In the second portion 13, the two shift grooves 11 partially overlap one another axially so that the two shift grooves 11 form a common groove 18. In other words, the two separate shift grooves 11 transform into one another against the rotation direction, wherein the two shift grooves 11 form a common groove 18 from the crossing point KP. In the second portion 13, there is no web between the two shift grooves 11.

The common groove 18 has a groove width which is greater than the groove width of the respective shift groove 11 in the first portion. The groove width of the common groove 18 may correspond to twice the groove width of the respective shift groove 11 in the first portion 12. The groove width of the common groove 18 may also be less than or equal to twice the width of the respective shift groove 11 in the first portion 12.

According to FIG. 3, the two shift grooves 11 each have an inlet flank 15 in the first portion 12 and an outlet flank 16 in the second portion 13, the flanks running parallel to one another and at an axial distance X from one another which corresponds to at least half the total axial shift stroke GSH of the shift gate 10. The axial distance X is formed between the respective inlet flank 15 of the two shift grooves 11 and the respective outlet flank 16 of the respective axially opposite shift groove 11.

Furthermore, in the first portion 12, the shift grooves 11 each have an acceleration flank 23 for an actuator pin 20, which extends from the inlet flank 15 towards the intersection region 14. The acceleration flank 23 here has axial offset which corresponds to the maximum axial shift stroke SH. Furthermore, in the second portion 13, starting from the intersection region 14, the shift grooves 11 each have a braking flank 17 for braking the actuator pin 20, which forms a continuous transition towards the outlet flank 16. The respective braking flank 17 is configured so as to be accurate. The acceleration flank 23 is structurally separated from the braking flank 17 in the intersection region 14. In the intersection region 14, the acceleration flank 23 of the respective shift groove 11 structurally transforms into the braking flank 17 of the respective other shift groove 11.

A sliding process of the shift gate 10 is described below in which the shift gate 10 is moved from a first axial position to a second axial position. An actuator pin 20 of a multiple actuator (not shown) cooperates with one of the shift grooves 11. During the sliding process, the shift gate 10 rotates and the actuator pin 20 is arranged in a fixed location in the circumferential direction. It performs only an insertion and retraction movement relative to the shift groove 11.

In a first step, the actuator pin 20 enters the shift groove 11 in the first portion 12 and is force-guided in the circumferential direction between the guide web 19 and the inlet flank 15. The shift groove 11 is designed so as to be sufficiently wide for a clearance to form between the guide web 19 and the inlet flank 15 or acceleration flank 23.

As the shift gate 10 rotates further, the inlet flank 15 transforms into the acceleration flank 23. The actuator pin 20 slides along the acceleration flank 23, wherein the shift gate 10 slides in the sliding direction. When the actuator pin 20 is in the intersection region 14 of the two shift grooves 11, at the maximum axial shift stroke SH of the shift groove 11, the shift gate 10 has moved over half the total axial shift stroke GSH of the shift gate 10. In this position, the shift gate 10 is closer to the second axial position than the first axial position, so that the shift gate 10 is pulled, e.g. by a latching device, to the second axial position. In the intersection region 14, the actuator pin 20 changes from the acceleration flank 23 to the braking flank 17 of the shift groove 11, and slides along this in the second portion 12. Then the actuator pin 20 transfers from the braking flank 17 to the outlet flank 16, wherein the shift gate 10 is here situated at the second axial position, in particular the axial end position.

For axial sliding of the shift gate 10, two actuator pins 20 are provided, wherein a respective one of the actuator pins 20 cooperates with the shift gate 10 to slide in one of the two sliding directions. The two actuator pins 20 have an axial distance X' from one another which corresponds to the axial distance X between the inlet flank 15 of the respective one shift groove 11 and the outlet flank 16 of the respective other shift groove 11.

LIST OF REFERENCE SIGNS

10 Shift gate
11 Shift grooves
12 First portion
13 Second portion
14 Intersection region
15 Inlet flank
16 Outlet flank
17 Braking flank
18 Common groove
19 Guide web
20 Actuator pin
21 Opening region
22 Parallel shift groove regions
23 Acceleration flank
SH Maximum axial shift stroke of shift grooves
GSH Total axial shift stroke of shift gate
KP Crossing point
X Axial distance between inlet and outlet flanks
X' Axial distance between actuator pins

What is claimed is:

1. A shift gate for a sliding cam system, comprising:

a plurality of shift grooves for engagement of an actuator pin, wherein the shift grooves run against a direction of rotation and transform from a first inlet portion for the actuator pin into a second outlet portion for the actuator pin, wherein the shift grooves cross one another at a crossing point in an intersection region between the first inlet portion and the second outlet portion, wherein in the intersection region each of the shift grooves has a maximum axial shift stroke that is greater than half a total axial shift stroke of slide travel of the shift gate, and wherein the maximum axial shift stroke of the shift grooves is less than the total axial shift stroke of the shift gate wherein the shift grooves are partially axially overlapping in the second outlet portion so that the shift grooves form a common groove, wherein the common groove includes a groove width that is greater than a groove width of a respective shift groove of the shift grooves in the first inlet portion, and wherein the groove width of the common groove is at a minimum at the crossing point.

2. The shift gate of claim 1, wherein each of the shift grooves has an inlet flank in the first inlet portion and an outlet flank in the second outlet portion, wherein the inlet flank and the outlet flank are parallel to one another and are spaced apart by an axial distance that corresponds to at least half the total axial shift stroke of the shift gate.

3. The shift gate of claim 2, wherein in the second outlet portion, starting from the intersection region, each of the shift grooves comprises a braking flank for braking the actuator pin, each of the braking flanks forms a continuous transition to the outlet flank.

4. The shift gate of claim 3, wherein the braking flank is arcuate at least in portions.

5. The shift gate of claim 1, wherein the shift grooves are spaced apart in the first inlet portion.

6. The shift gate of claim 1, comprising a guide web disposed between the shift grooves, wherein in the first inlet portion the guide web extends at least partially along the shift grooves and tapers towards the intersection region.

7. A camshaft that includes the shift gate of claim 1.

8. A sliding cam system comprising:

a double pin actuator; and a sliding cam element that includes a shift gate and is lockable in at least two axial positions, wherein the shift gate includes a plurality of shift grooves, wherein during a sliding process, a respective one of the shift grooves cooperates with an actuator pin of the double pin actuator, wherein the shift grooves run against a rotation direction and transform from a first portion into a second portion, wherein the shift grooves cross one another between the first portion and the second portion, wherein each of the shift grooves has a maximum axial shift stroke that is greater than half a total axial shift stroke of the shift gate, wherein the maximum axial shift stroke of the shift grooves is less than the total axial shift stroke of the shift gate, wherein the shift grooves partially are axially overlapping in the second portion so that the shift grooves form a common groove, wherein the common groove includes a groove width that is at least twice a groove width of a respective shift groove of the shift grooves in the first portion.

9. The sliding cam system of claim 8, wherein the total axial shift stroke of the shift gate is substantially equal to a distance between the at least two axial positions of the sliding cam element.

10. The sliding cam system of claim 8, wherein the actuator pin is a first actuator pin of at least two actuator pins of the double pin actuator, wherein the at least two actuator pins are spaced apart by a distance that corresponds to at least half of the total axial shift stroke of the shift gate.

* * * * *